US009525221B2

(12) United States Patent
Okada

(10) Patent No.: US 9,525,221 B2
(45) Date of Patent: Dec. 20, 2016

(54) PRESS-FIT PIN HAVING A NON-CONDUCTIVE PORTION EXTENDING FROM A FRONT OF A CONDUCTIVE PRESS-FIT PORTION

(71) Applicant: FUJITSU LIMITED, Kawasaki-shi, Kanagawa (JP)

(72) Inventor: Akira Okada, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/810,937

(22) Filed: Jul. 28, 2015

(65) Prior Publication Data

US 2016/0072207 A1 Mar. 10, 2016

(30) Foreign Application Priority Data

Sep. 8, 2014 (JP) ..... 2014-182513

(51) Int. Cl.
*H01R 12/00* (2006.01)
*H01R 12/58* (2011.01)

(52) U.S. Cl.
CPC ..... *H01R 12/585* (2013.01)

(58) Field of Classification Search
CPC ..... H01R 12/04; H01R 12/32; H01R 12/585; H01R 13/04; H01R 13/42
USPC ..... 439/74, 75, 81, 82, 84
See application file for complete search history.

(56) References Cited

U.S. PATENT DOCUMENTS 7,628,629 B2 * 12/2009 Miyazaki ..... H01R 13/6315 439/248
2009/0215288 A1 * 8/2009 Miyazaki ..... H01R 13/6315 439/74

FOREIGN PATENT DOCUMENTS

JP 2003-346950 12/2003
JP 2005-158507 6/2005
JP 2006-172986 6/2006

* cited by examiner

*Primary Examiner* — Chandrika Prasad
(74) *Attorney, Agent, or Firm* — Staas & Halsey LLP

(57) ABSTRACT

A connector includes: a press-fit pin wherein the press-fit pin includes a conductive press-fit portion configured to be press-fitted into a through hole formed in a substrate, and a non-conductive guide pin portion extending from a front end portion of the press-fit portion, the guide pin portion being configured to be inserted into the through hole.

20 Claims, 19 Drawing Sheets

PRESS-FIT PIN HAVING A NON-CONDUCTIVE PORTION EXTENDING FROM A FRONT OF A CONDUCTIVE PRESS-FIT PORTION

CROSS-REFERENCE TO RELATED APPLICATION

This application is based upon and claims the benefit of priority of the prior Japanese Patent Application No. 2014-182513 filed on Sep. 8, 2014, the entire contents of which are incorporated herein by reference.

FIELD

The embodiments disclosed herein are related to a connector and an electronic device.

BACKGROUND

A connector including a press-fit pin is known in which the press-fit pin is press-fitted into a through hole formed in a substrate to be electrically connected with the substrate.

Such a kind of press-fit pin is press-fitted into the through hole by a press machine in the state where the pin is temporarily inserted into the through hole, for example.

From the view point of reducing the effect of noise by reflection, the length of the press-fit pin is preferably short.

However, when the length of the press-fit pin is short, it may be difficult to temporarily insert the press-fit pin into the through hole.

The following are reference documents.

[Document 1] Japanese Laid-Open Patent Publication No. 2006-172986,

[Document 2] Japanese Laid-Open Patent Publication No. 2005-158507, and

[Document 3] Japanese Laid-Open Patent Publication No. 2003-346950.

SUMMARY

According to an aspect of the invention, a connector includes: a press-fit pin wherein the press-fit pin includes a conductive press-fit portion configured to be press-fitted into a through hole formed in a substrate, and a non-conductive guide pin portion extending from a front end portion of the press-fit portion, the guide pin portion being configured to be inserted into the through hole.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, an embodiment of the technology disclosed herein will be described.

Figure 1:
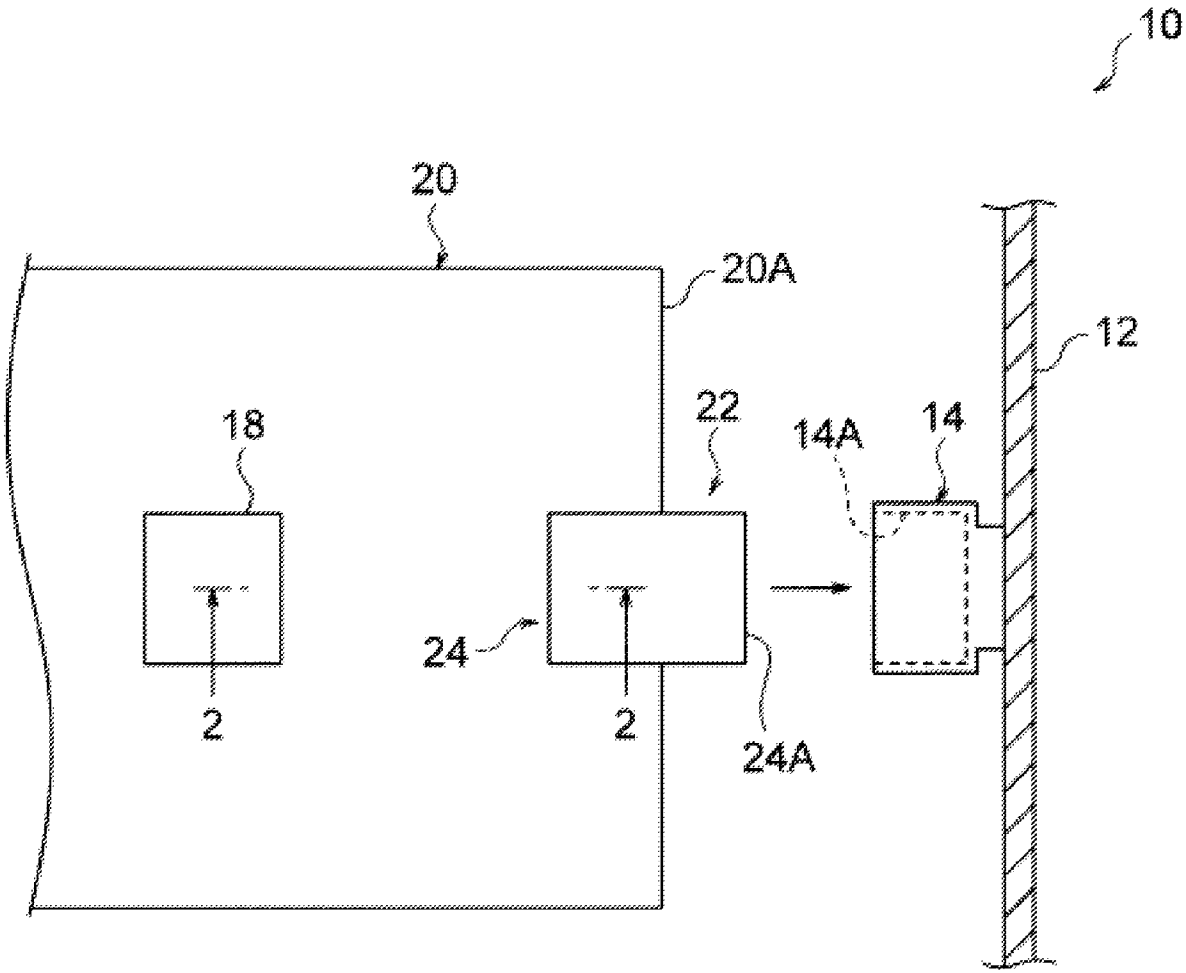
FIG. 1 is a vertical sectional view illustrating a pair of substrates in an electronic device according to an embodiment.

As illustrated in FIG. 1, an electronic device 10 according to the present embodiment is an optical communication device, for example. The electronic device 10 includes a pair of substrates 12 and 20. The substrates 12 and 20 include connectors 14 and 22, respectively, which are electrically connected with each other.

One substrate 12 of the pair of substrates 12 and 20 becomes a back wiring board provided on a rack (not illustrated), for example. The other substrate 20 becomes an extension substrate which is mounted on the rack (not illustrated), for example, to be electrically connected to another substrate (not illustrated) via the substrate 12.

Figure 2:
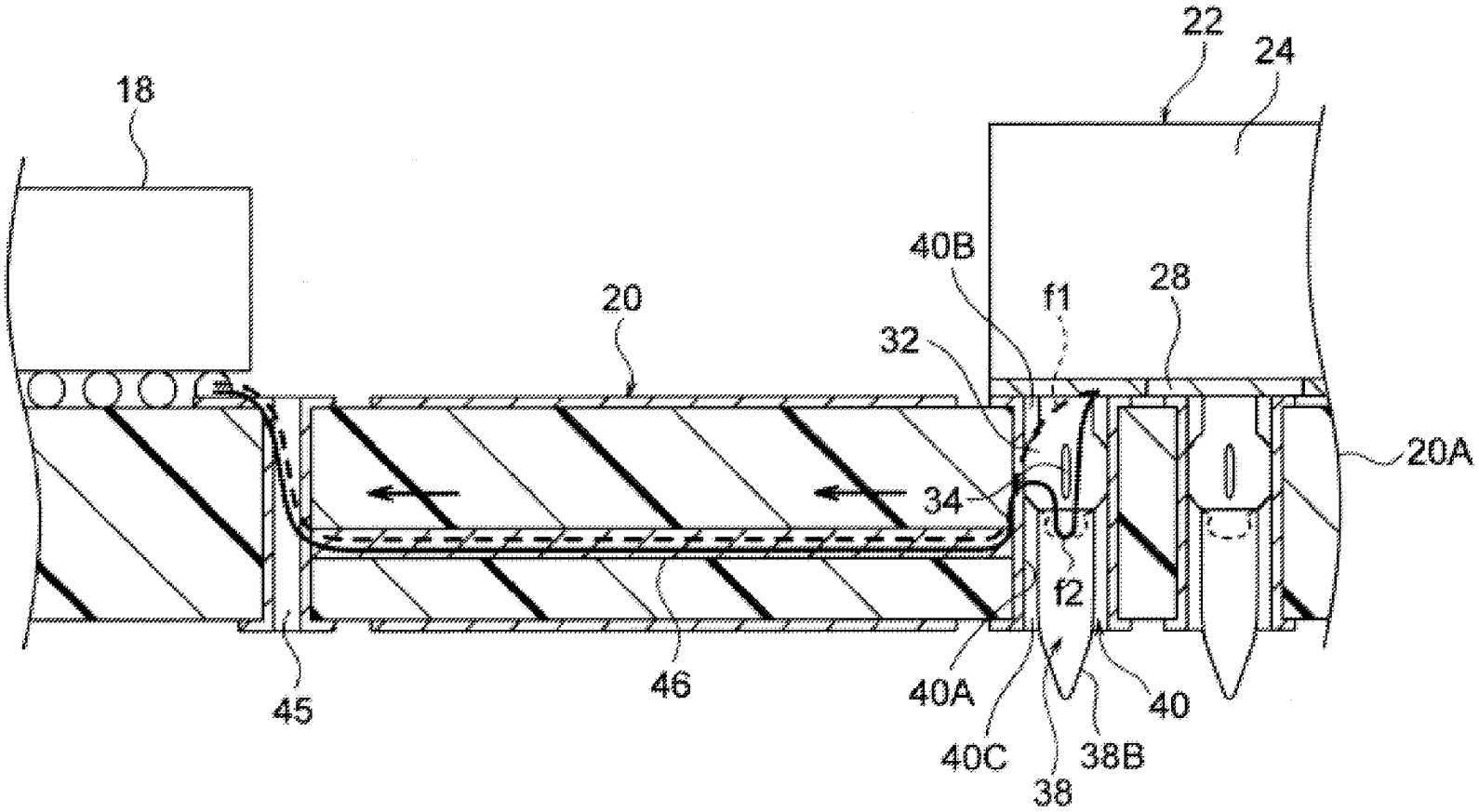
FIG. 2 is a sectional view taken along line 2-2 of FIG. 1.

As illustrated in FIG. 2, an electronic part 18 is mounted on the other substrate 20 to be electrically connected to the connector 22 via a through hole 45 and printed wiring 46. The through hole 45 is not illustrated in FIG. 1.

Figure 3:
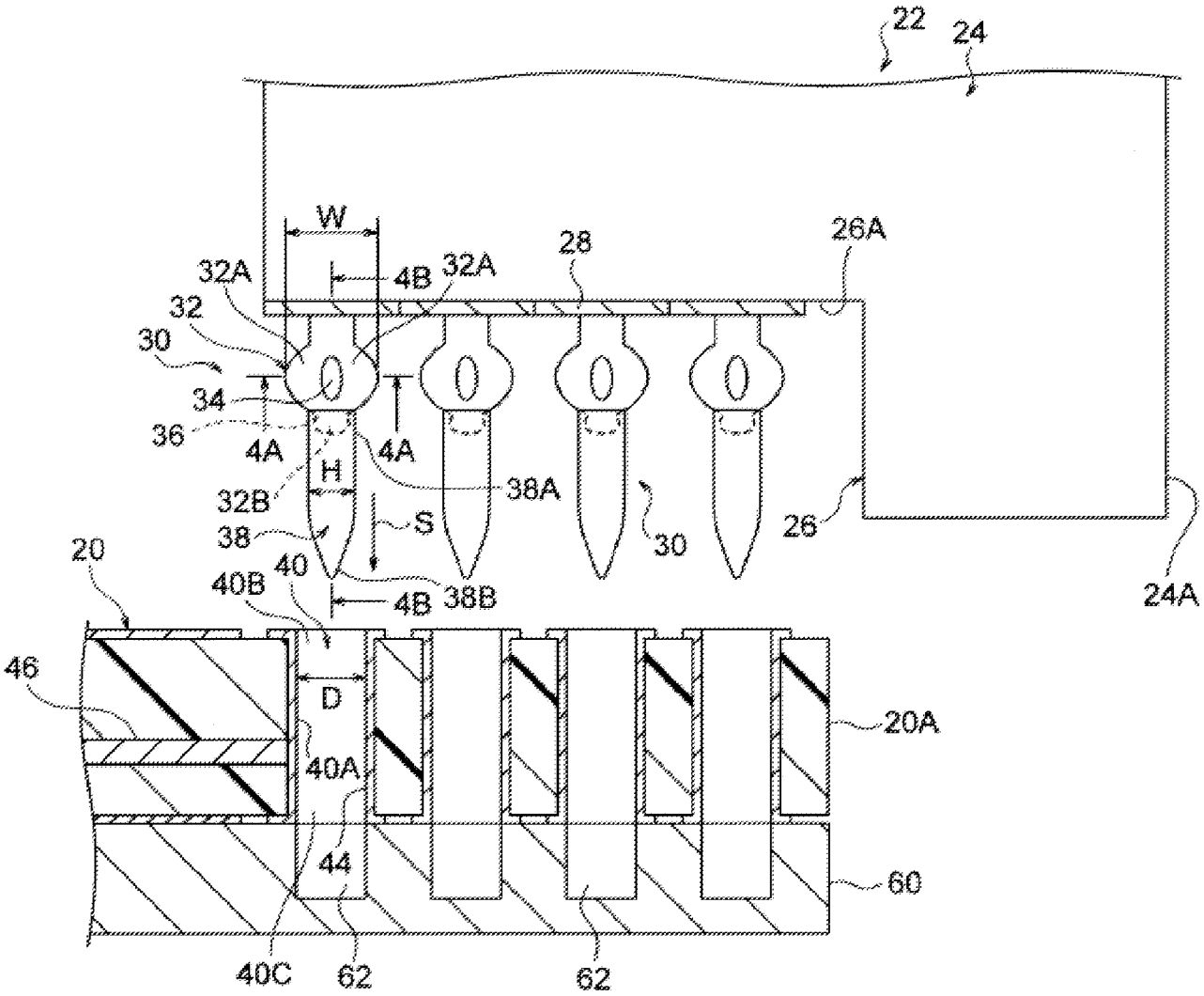
FIG. 3 is an enlarged view illustrating a substrate and a connector of FIG. 2 in a disassembled state.

As illustrated in FIG. 3, the connector 22 includes a connector body 24, a base portion 28, and a plurality of press-fit pins 30. The connector body 24 is formed in a rectangular parallelepiped shape. A connecting portion 24A connected to the above-described connector 14 is provided on an end of the connector body 24. Further, a recess 14A (see, e.g., FIG. 1), into which a connecting portion 24A is inserted, is formed on an end of the connector 14.

Further, the connector body 24 is formed with a notch portion 26 in which an end 20A of the substrate 20 is disposed. The base portion 28 is provided on a bottom surface 26A of the notch portion 26.

The base portion 28 is formed in a plate shape using, for example, a metal plate having conductivity, and is arranged along the bottom surface 26A of the notch portion 26. The base portion 28 is provided with the plurality of press-fit pins 30.

Figure 4A:
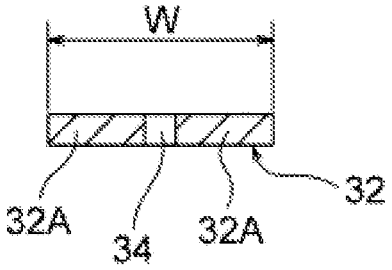
FIG. 4A is a sectional view taken along line 4A-4A of FIG. 3.
Figure 4B:
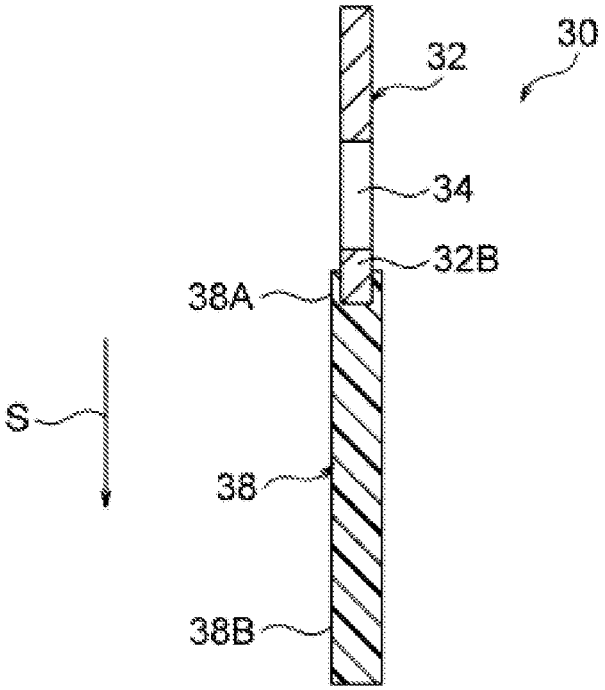
FIG. 4B is a sectional view taken along line 4B-4B of FIG. 3.

The plurality of press-fit pins 30 are arranged to be spaced apart from each other. As illustrated in FIG. 3 and FIGS. 4A and 4B, each press-fit pin 30 has a press-fit portion 32 and a guide pin portion 38. The press-fit portion 32 is formed of, for example, a conductive metal plate. The press-fit portion 32 is press-fitted into a through hole 40 formed in the substrate 20 to be pressure-welded to an inner circumferential surface 40A of the through hole 40. Thus, the connector 22 and the substrate 20 are electrically connected with each other.

The through hole 40 is formed by coating an inner circumferential surface of a circular hole, penetrating through the substrate 20 made of a resin material in a thickness direction, with a conductive film 44. The conductive film 44 is formed of a metal film such as, for example, conductive plating, for example, so as to define the inner circumferential surface 40A of the through hole 40. This conductive film 44 is electrically connected to the printed wiring 46.

The press-fit portion 32 has a wide portion having a width W larger than the diameter D of the through hole 40, and is press-fitted into the through hole 40 from an opening 40B of the through hole 40. The press-fit portion 32 has a through hole 34 and a pair of elastic deformation portions 32A. The through hole 34 is formed in the central portion of the press-fit portion 32. The through hole 34 is an elongate hole extending in an insertion direction of the press-fit pin 30 into the through hole 40 (the direction indicated by arrow S).

The pair of elastic deformation portions 32A are disposed on opposite sides of the through hole 34. The pair of elastic deformation portions 32A are elastically deformed in mutually approaching directions as the press-fit portion 32 is press-fitted into the through hole 40 and pressure-welded to the inner circumferential surface 40A of the through hole 40. Therefore, the pair of elastic deformation portions 32A are electrically connected to the through hole 40.

Further, a catch portion 36 is formed on a front end portion 32B of the press-fit portion 32 to catch the guide pin portion 38. The catch portion 36 is a notch formed on the outer circumferential surface of the front end portion 32B, and thus is buried in a base end portion 38A of the guide pin portion 38. The base end portion 38A of the guide pin portion 38 is caught by the catch portion 36, thus preventing the guide pin portion 38 from being released from the front end portion 32B of the press-fit portion 32.

For example, the guide pin portion 38 is formed in a rod shape using a resin member having non-conductivity, and extends from the front end portion 32B of the press-fit portion 32. The width H of the guide pin portion 38 is smaller than the diameter D of the through hole 40.

Further, the front end portion 38B of the guide pin portion 38 becomes a tapered portion that is narrowed the tip end thereof. When the front end portion 38B comes into contact with a peripheral portion of one opening 40B of the through hole 40, the guide pin portion 38 and the press-fit portion 32 are guided into the through hole 40.

As illustrated in FIG. 2, the front end portion 38B of the guide pin portion 38 protrudes from the other opening 40C of the through hole 40 in the state where the base portion 28 is engaged with the substrate 20. Accordingly, it is easy for a worker to visually see and check whether the press-fit pin 30 is inserted into the through hole 40.

Next, an example of a method of manufacturing the press-fit pin 30 will be described.

Figure 5:
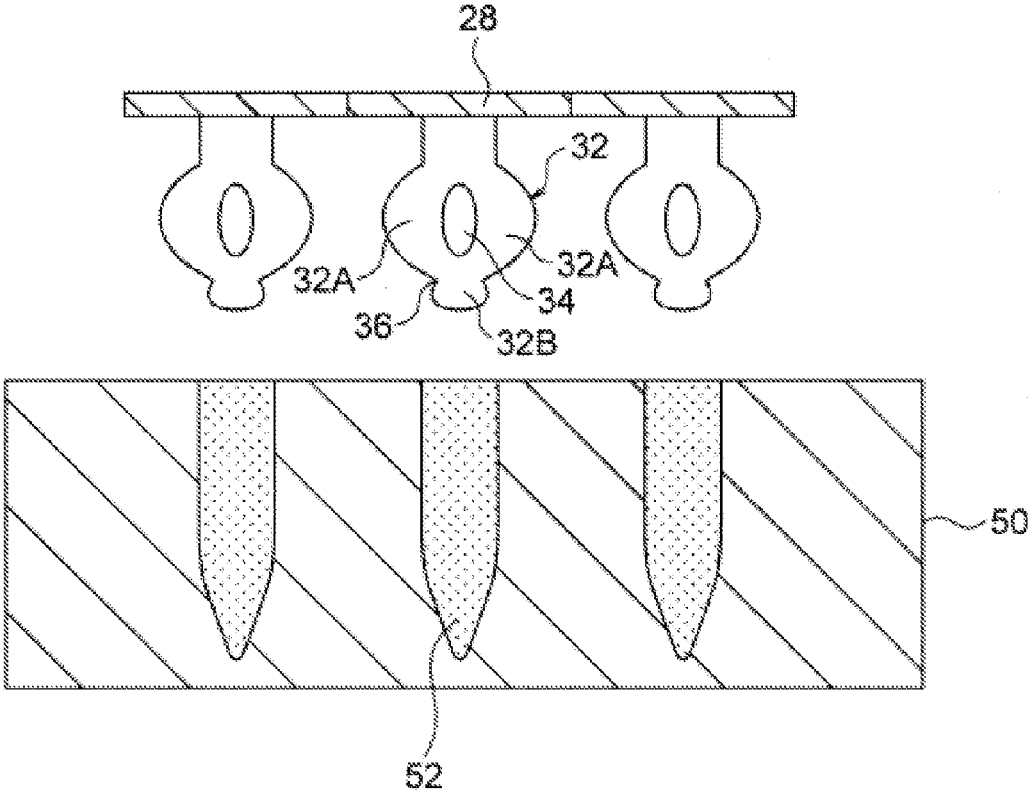
FIG. 5 is a sectional view illustrating a mold for manufacturing guide pin portions of press-fit pins illustrated in FIG. 2.
Figure 6:
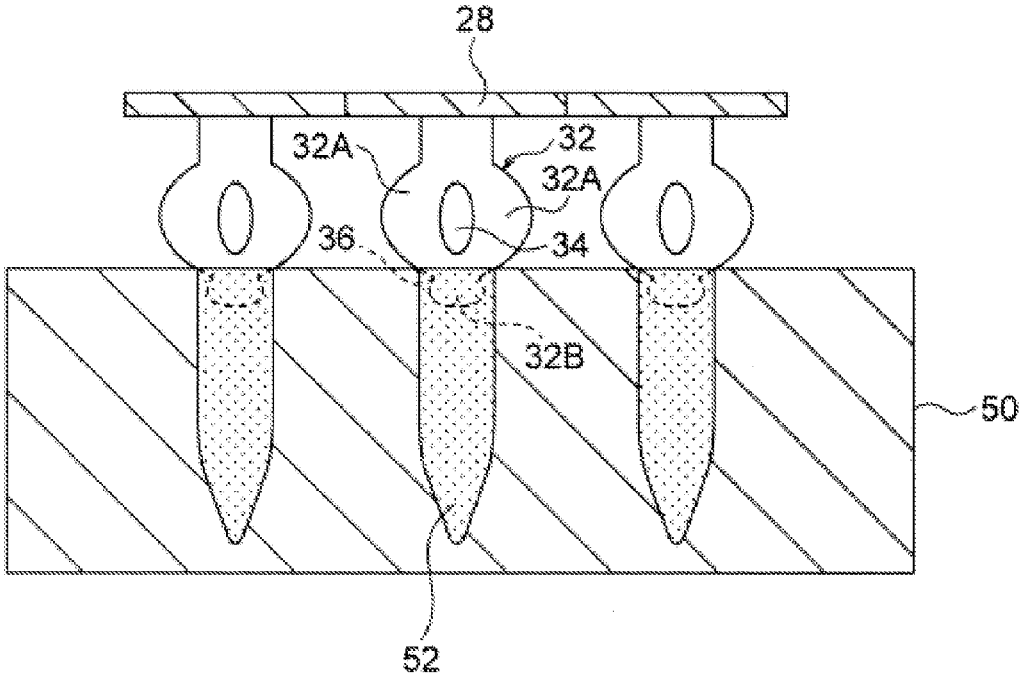
FIG. 6 is a sectional view illustrating the mold for manufacturing the guide pin portions of the press-fit pins illustrated in FIG. 2.

As illustrated in FIG. 5, first, a molten resin 52 such as, for example, a thermoplastic resin, is filled in a mold 50 for the guide pin portion 38. Next, as illustrated in FIG. 6, the front end portion 32B of the press-fit portion 32 is inserted into the mold 50. At this time, the molten resin 52 flows into the catch portion 36 formed in the front end portion 32B of the press-fit portion 32. In this state, the molten resin 52 is cured. Consequently, the guide pin portion 38 (see, e.g., FIG. 7) is formed, and the formed guide pin portion 38 is welded to the front end portion 32B of the press-fit portion 32.

Figure 7:
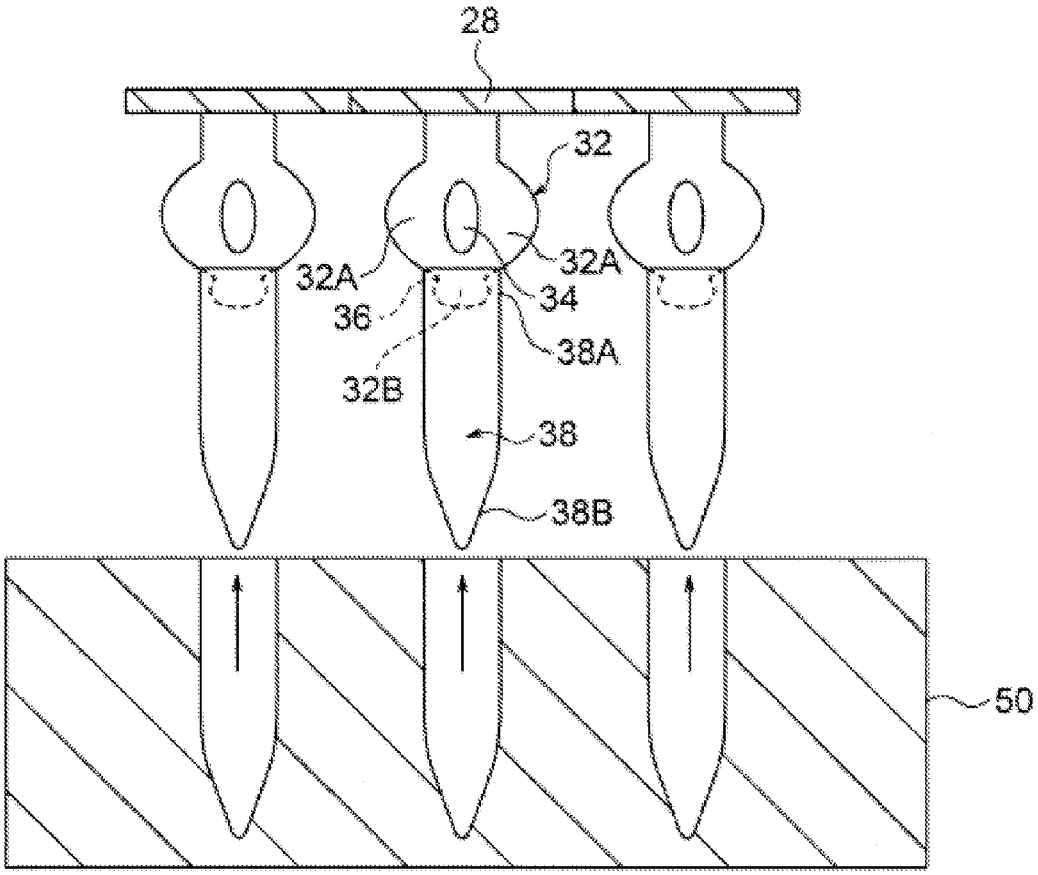
FIG. 7 is a sectional view illustrating the mold for manufacturing the guide pin portions of the press-fit pins illustrated in FIG. 2.

Next, as illustrated in FIG. 7, the formed guide pin portion 38 is pulled out from the mold 50 in a direction illustrated by the arrow. Accordingly, the press-fit pin 30, in which the press-fit portion 32 and the guide pin portion 38 are integrated with each other, is obtained. Further, the press-fit portion 32 is formed by, for example, a press process.

Next, a method of attaching the connector 22 to the substrate 20 (method of manufacturing the substrate 20) will be described.

Figure 8:
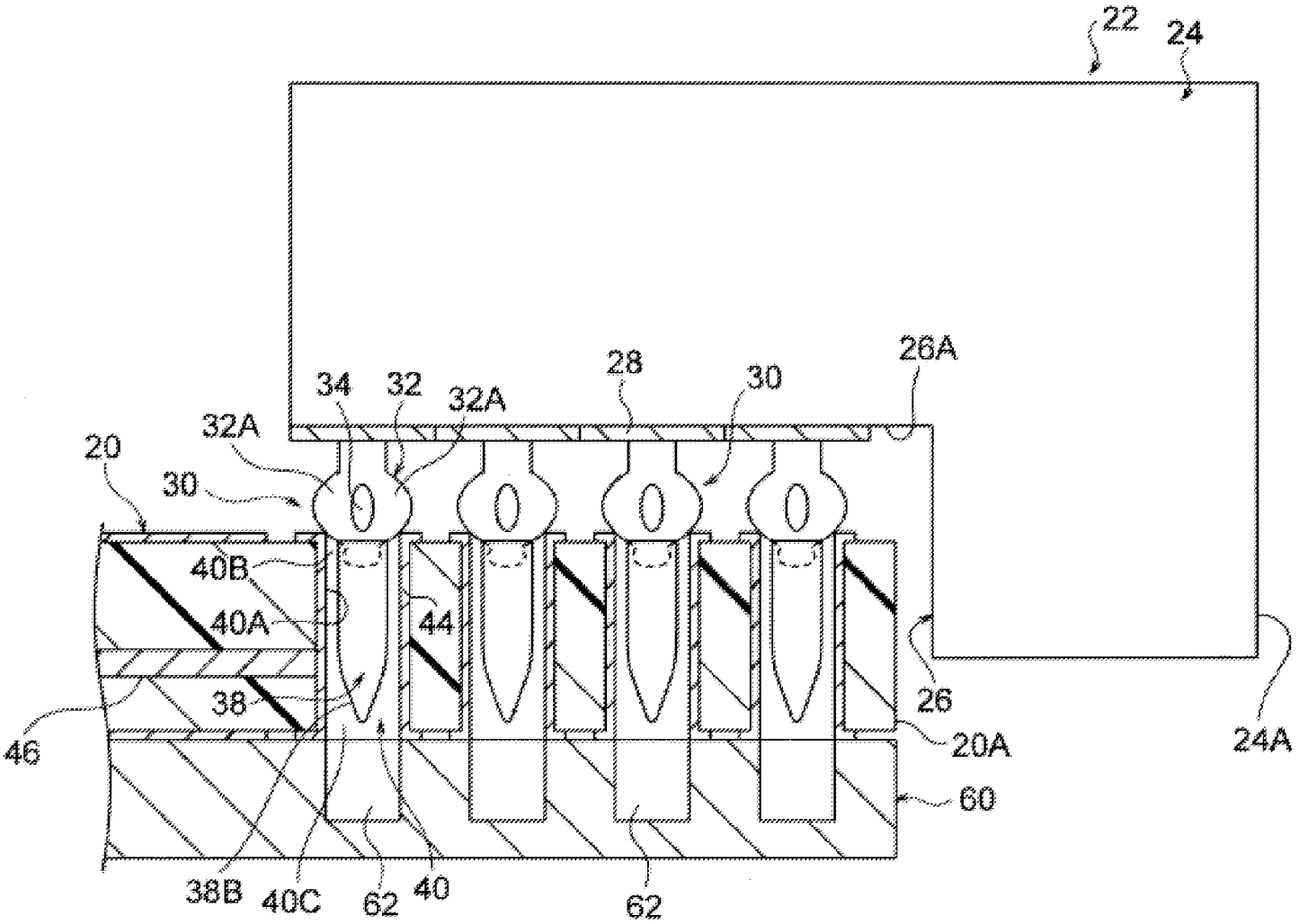
FIG. 8 is a sectional view illustrating a method of attaching the connector to the substrate illustrated in FIG. 2.

First, as illustrated in FIG. 8, the substrate 20 is mounted on a receiving jig 60. Further, a plurality of insert holes 62 are formed in the receiving jig 60 to correspond to the plurality of through holes 40 formed in the substrate 20, respectively.

Next, the plurality of press-fit pins 30 are temporarily inserted into the plurality of through holes 40, respectively, manually by a worker. Specifically, the guide pin portion 38 of each press-fit pin 30 is inserted into one through hole 40 until the press-fit portion 32 of each press-fit pin 30 comes into contact with the peripheral portion of the opening 40B of the through hole 40. At this time, the front end portion 38B of the guide pin portion 38 comes into contact with the peripheral portion of the opening 40B of the through hole 40 so that the guide pin portion 38 and the press-fit portion 32 are guided into the through hole 40.

In this regard, when the guide pin portions 38 are inserted into all of the through holes 40, respectively, the connector body 24 approaches the substrate 20. The worker determines whether the press-fit pins 30 are temporarily inserted into all of the through holes 40, respectively, based on the approaching of the connector body 24 to the substrate 20.

Further, as the length of the guide pin portion 38 increases, the approaching quantity (head) of the connector body 24 to the substrate 20 increases when the press-fit pin 30 is temporarily inserted into the through hole 40. For this reason, as the length of the guide pin portion 38 increases, it is easy for a worker to determine whether the press-fit pin 30 is temporarily inserted into the through hole 40.

Figure 9:
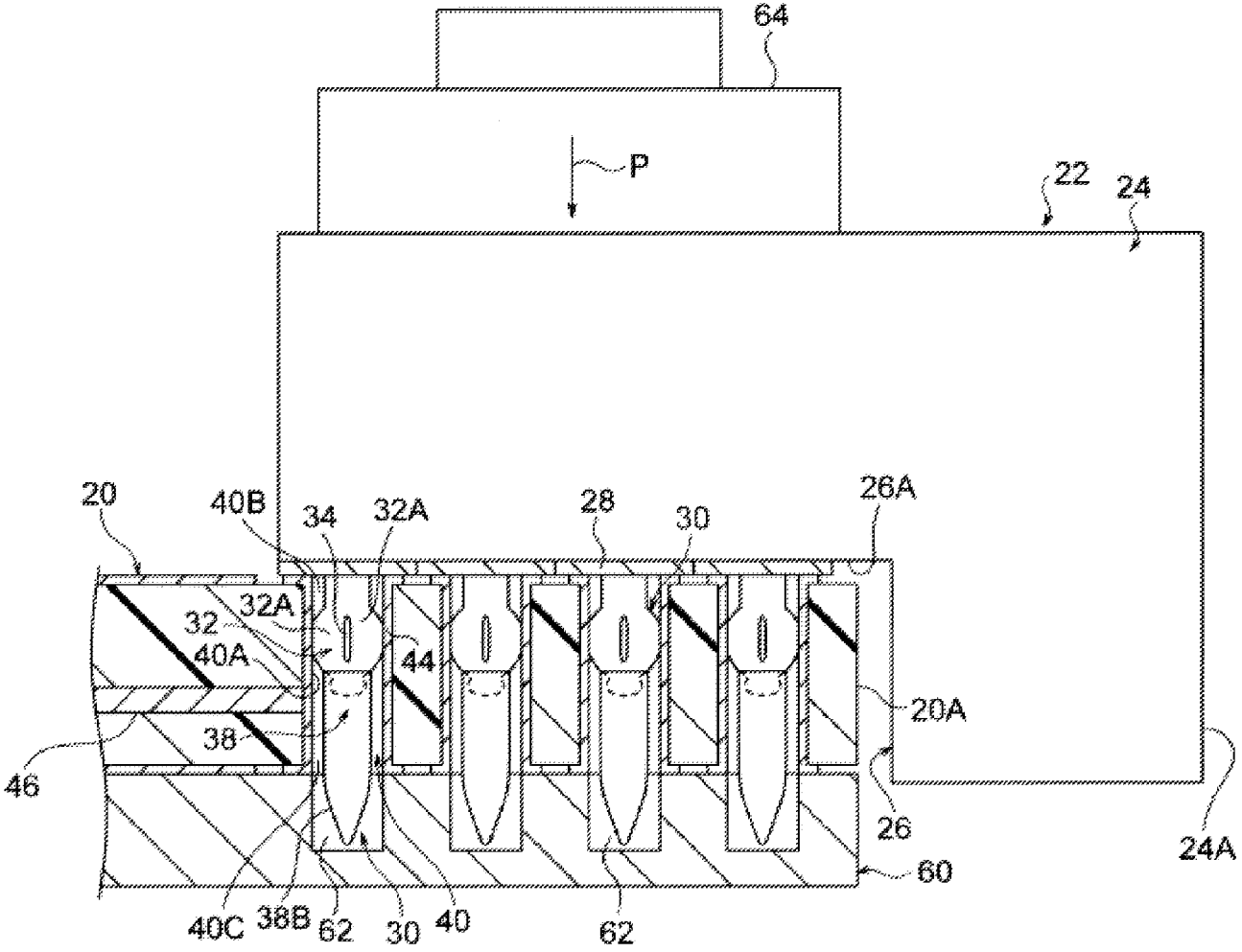
FIG. 9 is a sectional view illustrating the method of attaching the connector to the substrate illustrated in FIG. 2.

Next, as illustrated in FIG. 9, the press machine 64 is mounted on the connector body 24. Further, as illustrated by arrow P, until the base portion 28 is locked to (in contact with) the substrate 20, the connector body 24 is pressed towards the substrate 20 by the press machine 64. Accordingly, the press-fit portion 32 of each press-fit pin 30 is press-fitted into the through hole 40.

Moreover, when the press-fit portion 32 is press-fitted into the through hole 40, each of the pair of elastic deformation portions 32A is pressure-welded to the inner circumferential surface 40A of the through hole 40 so that the connector 22 and the substrate 20 are electrically connected with each other. Further, the front end portion 38B of the guide pin portion 38 protrudes from the other opening 40C of the through hole 40 to be inserted into the insert hole 62 of the receiving jig 60. Thus, the damage to the front end portion 38B of the guide pin portion 38 is suppressed.

Figure 10:
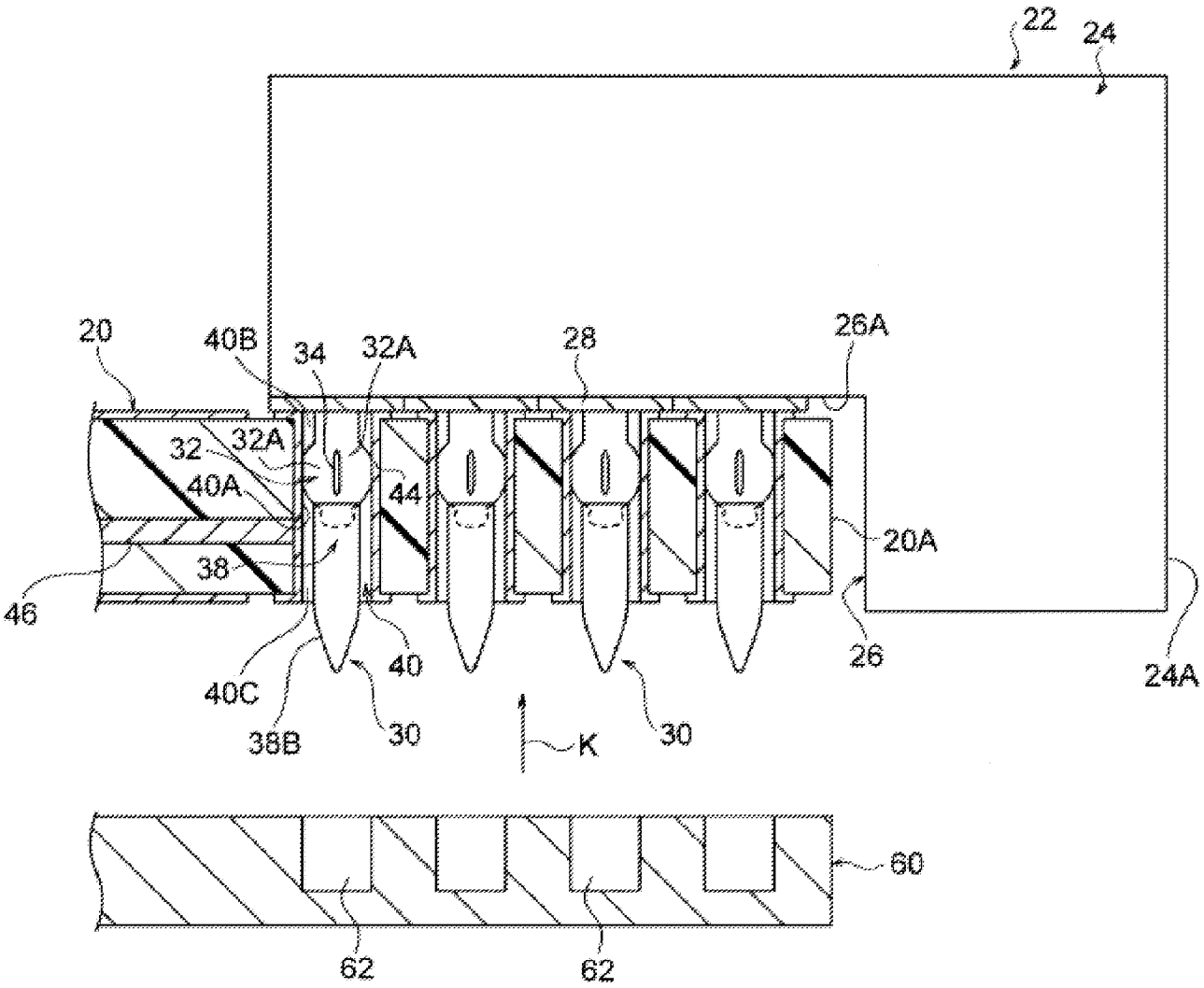
FIG. 10 is a sectional view illustrating the method of attaching the connector to the substrate illustrated in FIG. 2.

Next, as illustrated by arrow K in FIG. 10, the substrate 20 is separated from the receiving jig 60. In this way, the substrate 20 is manufactured.

Further, the front end portion 38B of the guide pin portion 38 protruding from the other opening 40C of the through hole 40 may be cut. Furthermore, after the press-fit portion 32 is press-fitted into the through hole 40, the guide pin portion 38 may be removed from the front end portion 32B of the press-fit portion 32.

Next, the effect of the present embodiment will be described.

Figure 11:
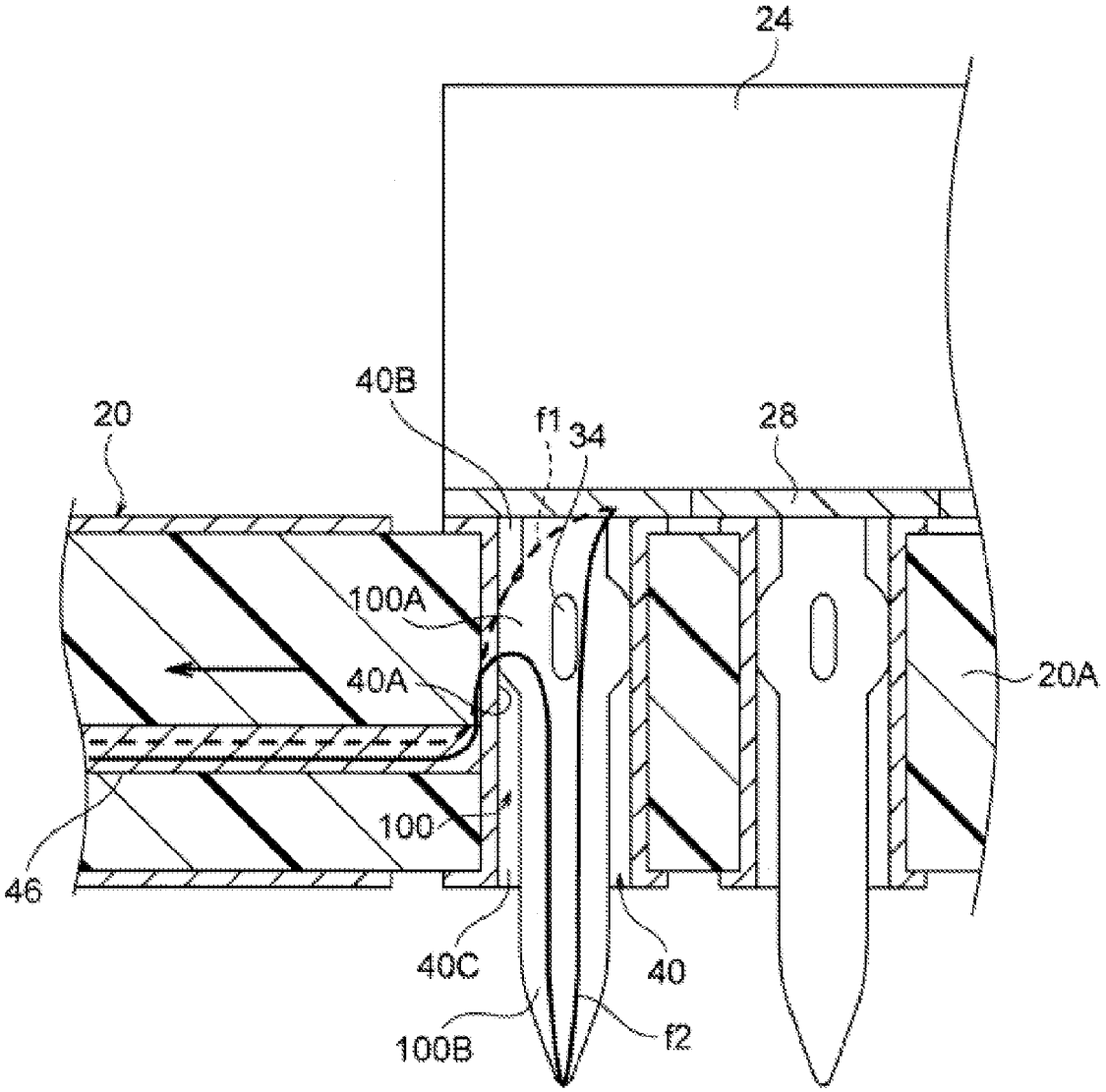
FIG. 11 is a sectional view illustrating a substrate in which press-fit pins according to a comparative example are inserted into through holes.
Figure 12:
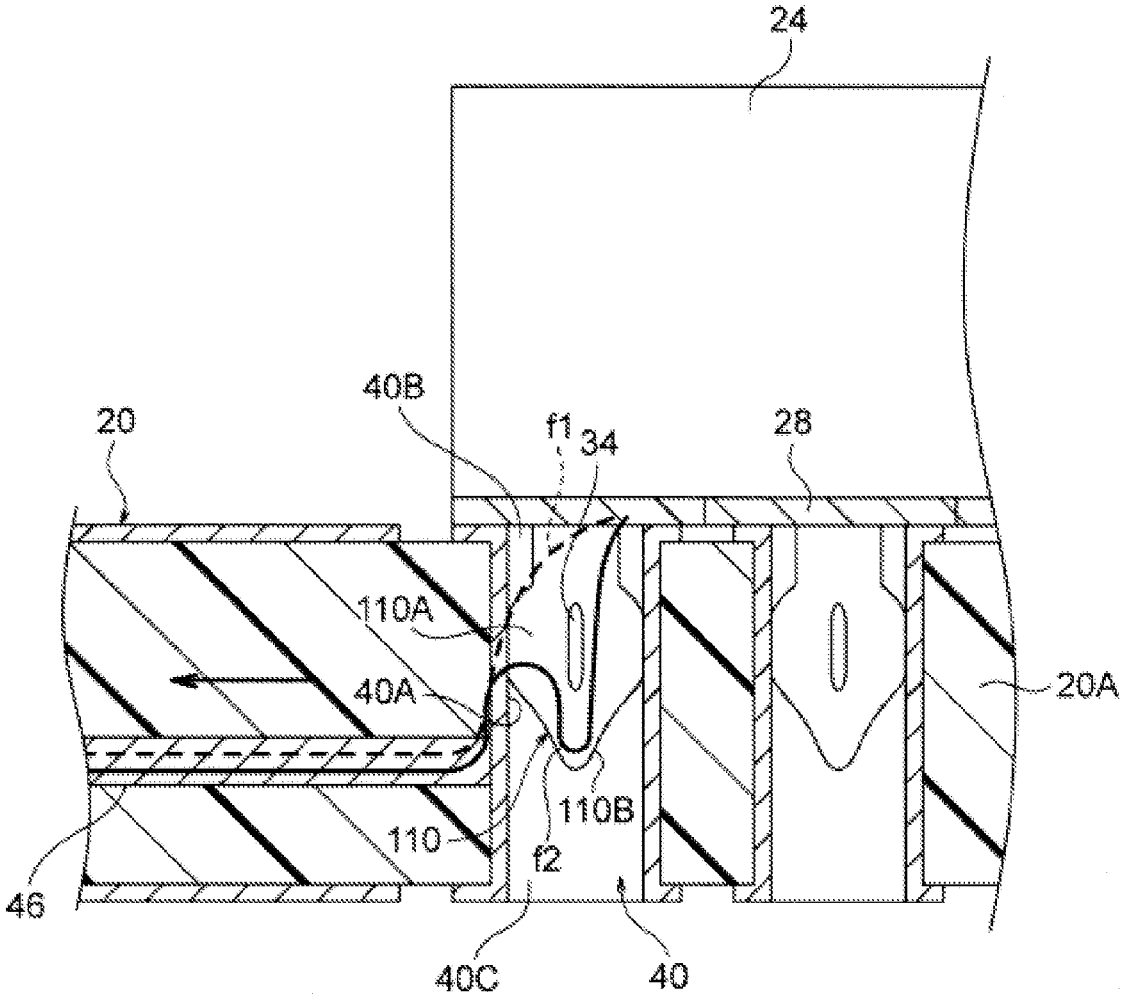
FIG. 12 is a sectional view illustrating a substrate in which press-fit pins according to a comparative example are inserted into through holes.

First, press-fit pins according to comparative examples will be described. FIGS. 11 and 12 illustrate press-fit pins 100 and 110 according to comparative examples. As illustrated in FIG. 11, each of the press-fit pins 100 according to the comparative example includes a press-fit portion 100A and a guide pin portion 100B which are formed integrally with each other using a conductive metal plate.

In each press-fit pin 100 according to this comparative example, the length of the guide pin portion 100B is long. Hence, when the press-fit pin 100 is temporarily inserted into a through hole 40, the approaching quantity of the connector body 24 to the substrate 20 increases. Thus, it is easy for a worker to determine whether the press-fit pin 100 is temporarily inserted into the through hole 40.

However, in the press-fit pin 100 according to the comparative example, the guide pin portion 38 is conductive. Hence, there is a possibility that an electric signal transmitted from the connector body 24 to the printed wiring 46 is reflected from the guide pin portion 100B, as illustrated by solid line f2, and thus becomes noise of the electric signal illustrated by a dashed line f1.

Hence, as in the press-fit pin 110 illustrated in FIG. 12, the length of the guide pin portion 110B extending from the front end portion of the press-fit portion 110A is preferably short. However, when the length of the guide pin portion 110B is short, the approaching quantity of the connector body 24 to the substrate 20 is decreased when the press-fit pins 110 are temporarily inserted into the through holes 40. Consequently, it may be difficult for a worker to determine whether the press-fit pins 110 are temporarily inserted into the through holes 40.

Figure 13:
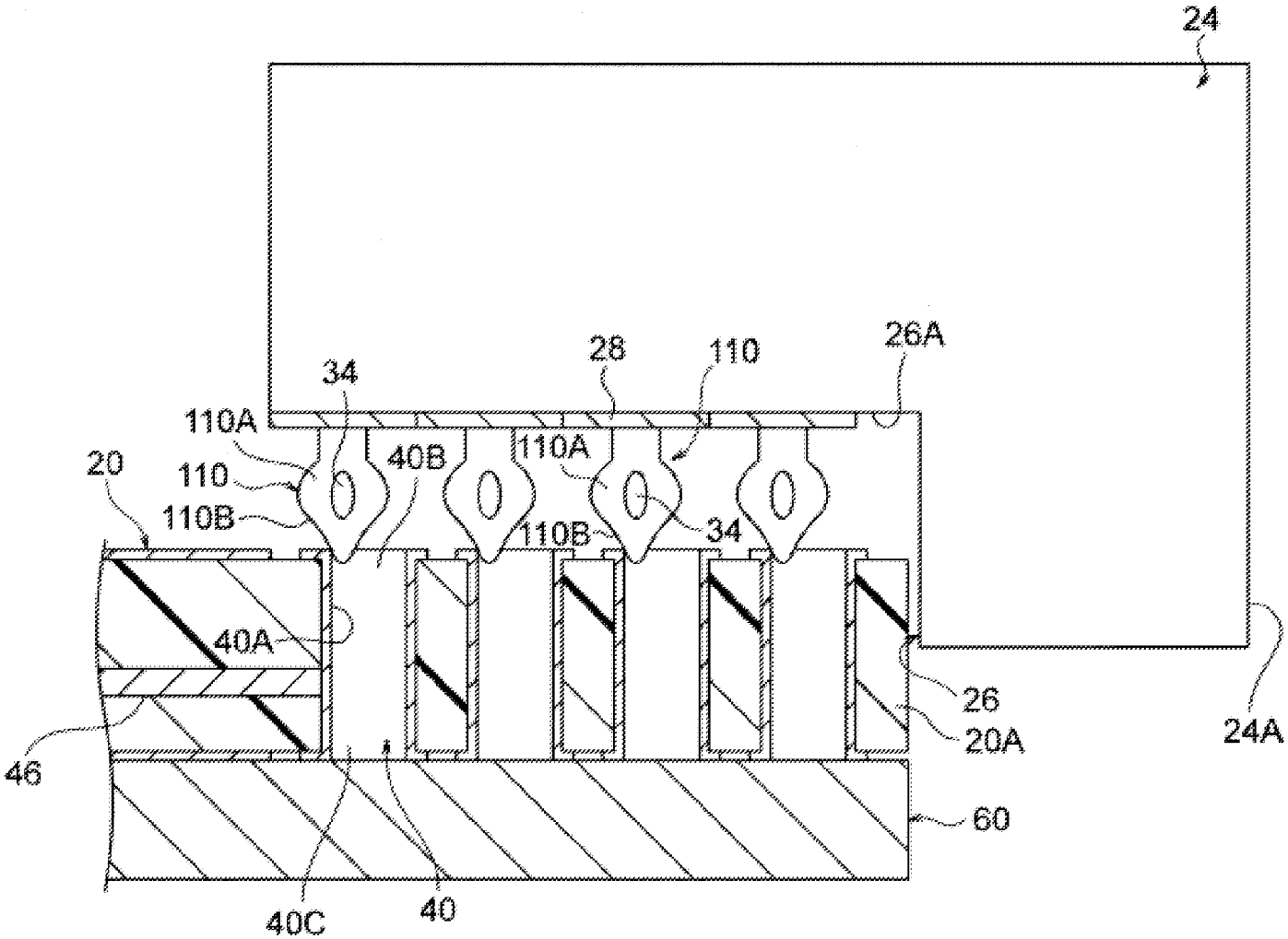
FIG. 13 is a sectional view illustrating a method of attaching a connector having press-fit pins to a substrate according to a comparative example.
Figure 14:
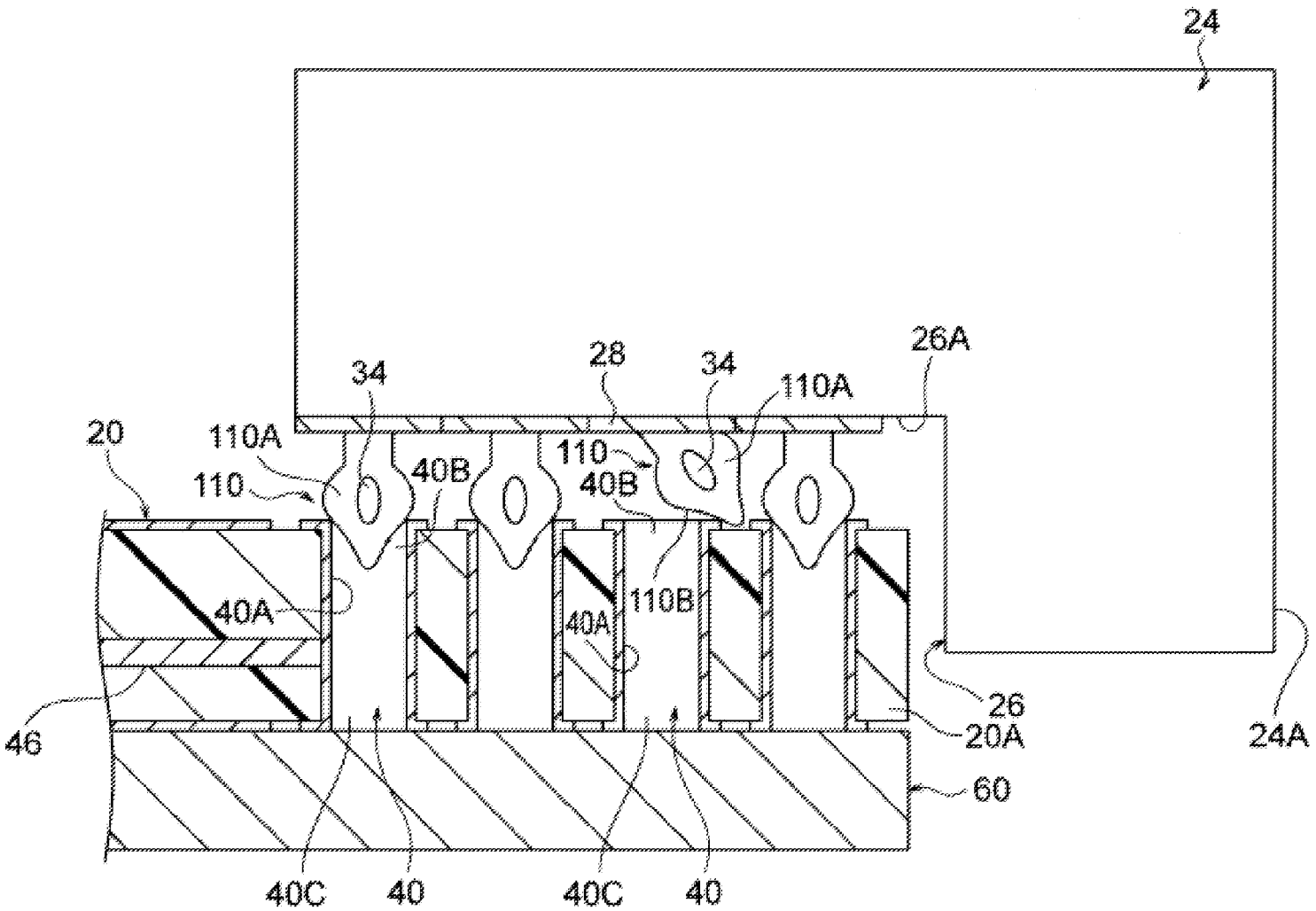
FIG. 14 is a sectional view illustrating a method of attaching a connector having press-fit pins to a substrate according to a comparative example.
Figure 15:
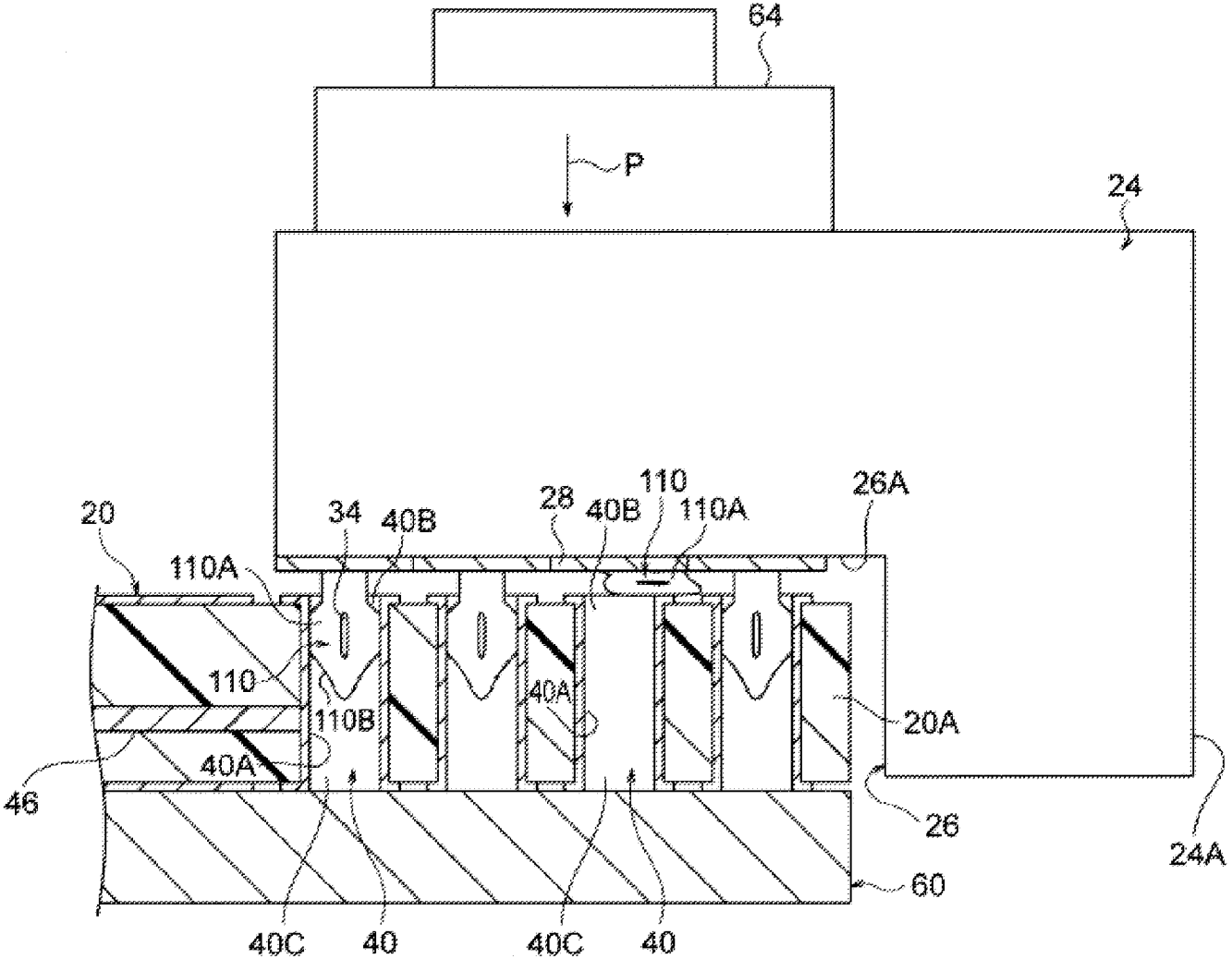
FIG. 15 is a sectional view illustrating a method of attaching a connector having press-fit pins to a substrate according to a comparative example.

In this case, for example, as illustrated in FIGS. 13 and 14, some of the plurality of press-fit pins 110 may not be temporarily inserted into the through holes 40. In this state, as illustrated in FIG. 15, when the connector body 24 is pressed towards the substrate 20 by the press machine 64 (arrow P), a press-fit pin 110 that is not temporarily inserted into the through hole 40 is crushed against the substrate 20.

In the present embodiment, the guide pin portion 38 is non-conductive. Accordingly, as illustrated by solid line f2 of FIG. 2, the reflection of the electric signal in the guide pin portion 38 is suppressed. Further, when the press-fit pins 30 is temporarily inserted into the through holes 40, the approaching quantity of the connector body 24 to the substrate 20 increases. Therefore, it is easy for a worker to determine whether the press-fit pins 30 are temporarily inserted into the through holes 40.

As such, in the present embodiment, it is easy for a worker to determine whether the press-fit pins 30 are temporarily inserted into the through holes 40 while the reflection of the electric signal from the guide pin portions 38 is suppressed. Thus, since it is easy for the worker to temporarily insert the press-fit pin 30 into the through hole 40, the workability of attaching the connector 22 to the substrate 20 is improved.

In addition, the front end portions 38B of the guide pin portions 38 protrude from the through holes 40 in the state where the press-fit portions 32 are press-fitted into the through holes 40. Accordingly, the worker may visually check whether the press-fit pins 30 are inserted (press-fitted) into all of the plurality of through holes 40, respectively. Therefore, the workability of attaching the connector 22 to the substrate 20 is improved.

Further, in the embodiment, the front end portion 38B of each guide pin portion 38 becomes a tapered portion that is narrowed toward the tip end. When the front end portion 38B of the guide pin portion 38 comes into contact with the peripheral portion of the opening 40B of a through hole 40, the guide pin portion 38 and the press-fit portion 32 are guided into the through hole 40. Therefore, it becomes easy to insert the guide pin portion 38 into the through hole 40.

In addition, the catch portion 36 buried in the base end portion 38A of the guide pin portion 38 is provided on the front end portion 32B of the press-fit portion 32. Thus, the removal of the base end portion 38A of the guide pin portion 38 from the front end portion 32B of the press-fit portion 32 is suppressed.

Next, a modification of the embodiment described above will be described.

In the embodiment described above, in the state where each press-fit portion 32 is press-fitted into a through hole 40, the front end portion 38B of the guide pin portion 38 protrudes from the opening 40B of the through hole 40.

Figure 16:
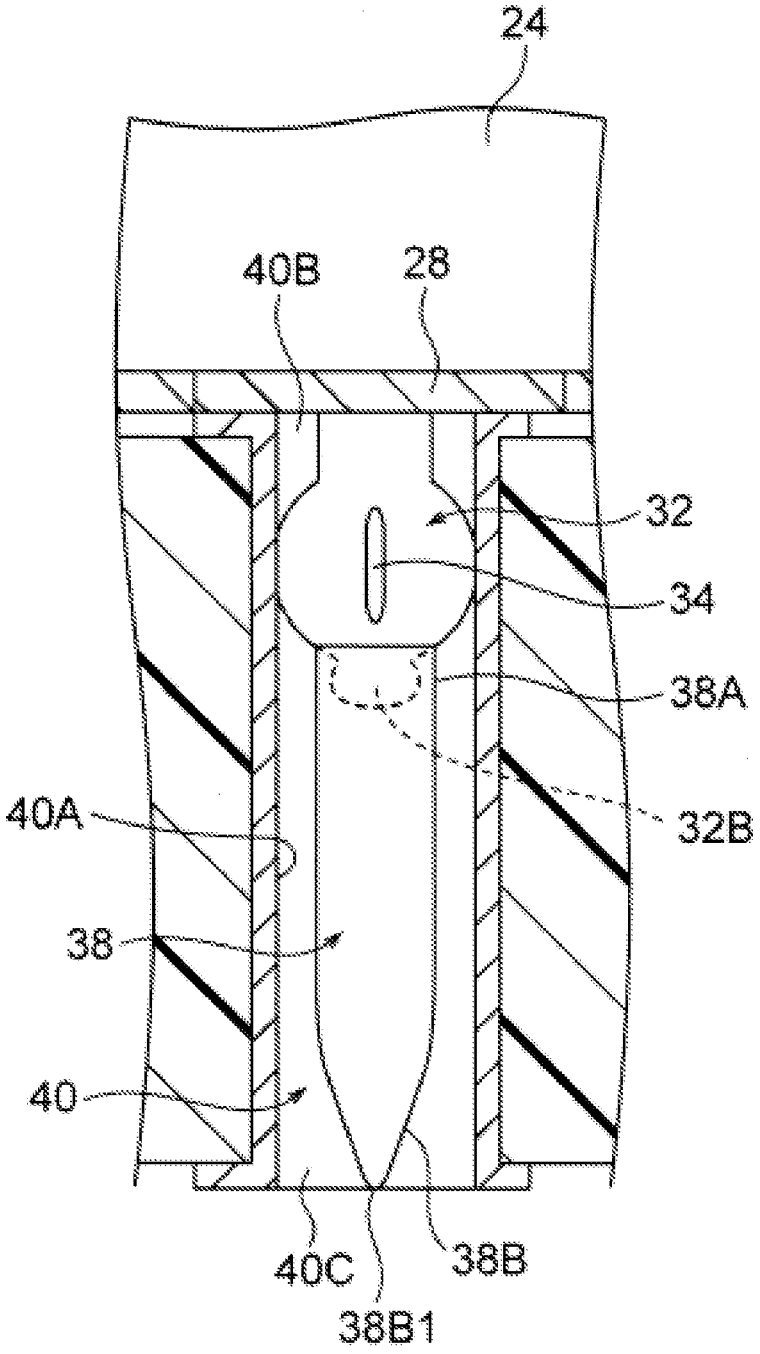
FIG. 16 is a sectional view illustrating a state in which a modification of the press-fit pin illustrated in FIG. 2 is inserted into a through hole.

However, for example, as illustrated in FIG. 16, a tip end 38B1 of the guide pin portion 38 may be located in the other opening 40C of the through hole 40 in the state where the press-fit portion 32 is press-fitted into the through hole 40. More specifically, the tip end 38B1 of the guide pin portion 38 may be located at the opening face of the other opening 40C of the through hole 40.

In this case, the front end portion 38B of the guide pin portion 38 does not protrude from the other opening 40C of the through hole 40. Thus, the receiving jig 60 (see, e.g., FIG. 9) may be omitted. Further, even though the front end portion 38B of the guide pin portion 38 does not protrude from the other opening 40C of the through hole 40, the worker may visually check whether the press-fit pin 30 is inserted into the through hole 40. Therefore, the workability of attaching the connector 22 to the substrate 20 is improved while the receiving jig 60 is omitted.

Figure 17:
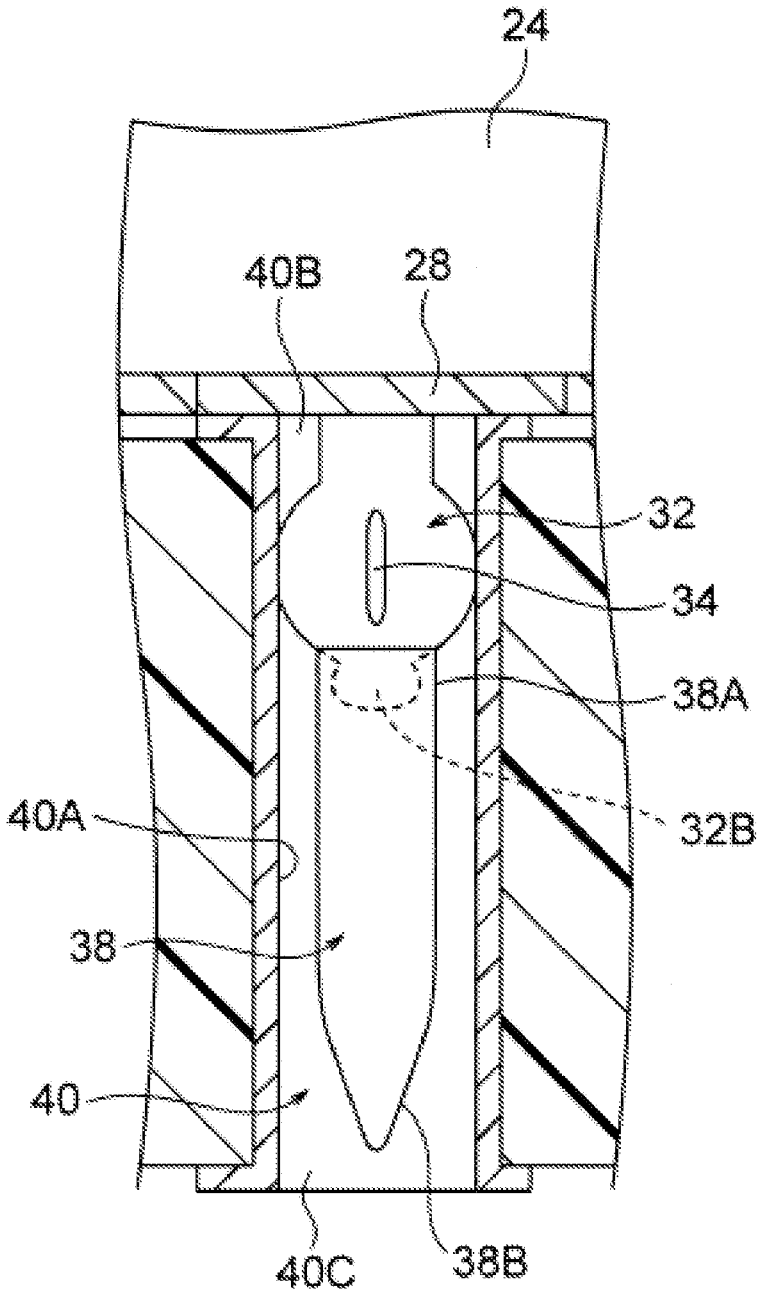
FIG. 17 is a sectional view illustrating a state in which a modification of the press-fit pin illustrated in FIG. 2 is inserted into a through hole.

Further, for example, as illustrated in FIG. 17, the front end portion 38B of the guide pin portion 38 may be located at the side of the other opening 40C of the through hole 40. Likewise in this case, it is easy for a worker to visually check whether the press-fit pin 30 is inserted into the through hole 40. Therefore, the workability of attaching the connector 22 to the substrate 20 is improved.

Furthermore, the front end portion 38B of the guide pin portion 38 may be located within the through hole 40 rather than at the side of the other opening 40C of the through hole 40. In this case, it may be difficult for a worker to visually check whether the press-fit pin 30 is inserted into the through hole 40, but the receiving jig 60 may be omitted.

Further, the front end portion 38B of the guide pin portion 38 may be, for example, colored by a color that is visually easily distinguishable from the substrate 20 by the worker, such as a color that is higher in brightness or chroma than the substrate 20 (conductive film 44) or a fluorescent color.

Figure 18:
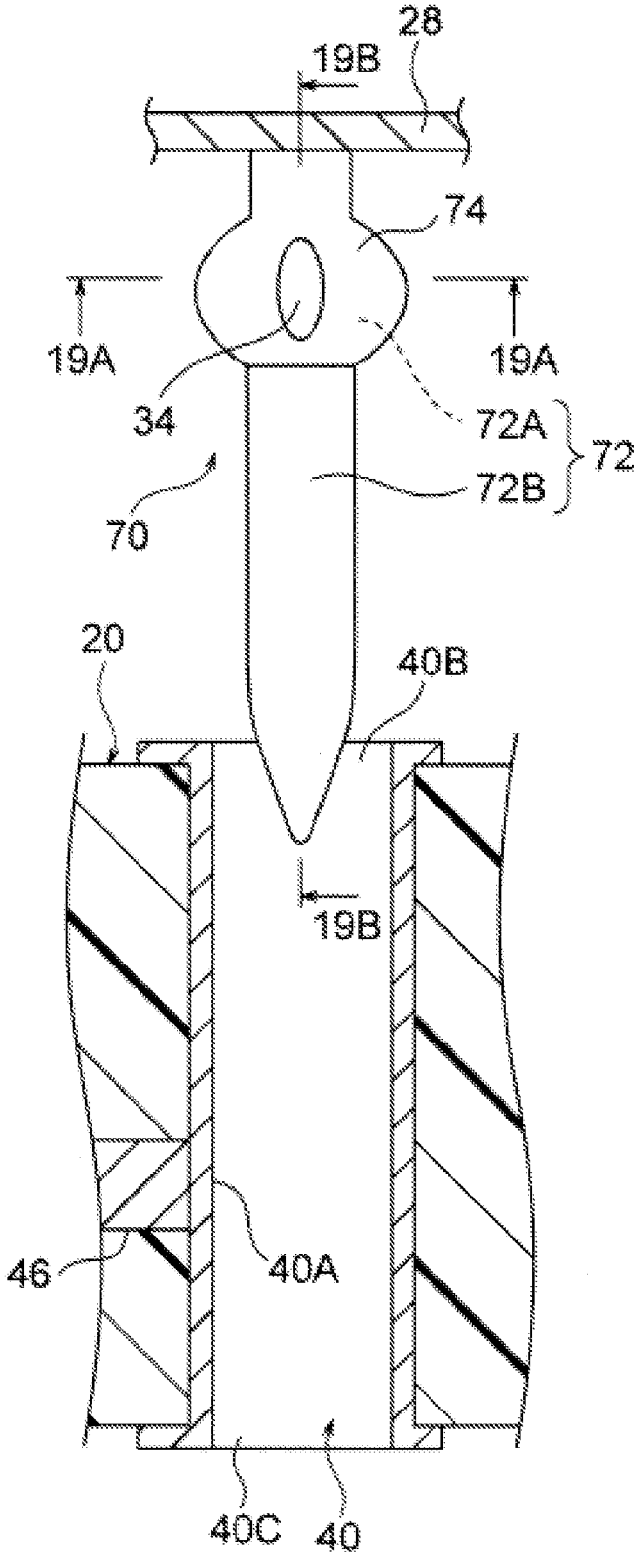
FIG. 18 is a sectional view illustrating a state before a modification of the press-fit pin illustrated in FIG. 2 is inserted into a through hole.
Figure 19A:
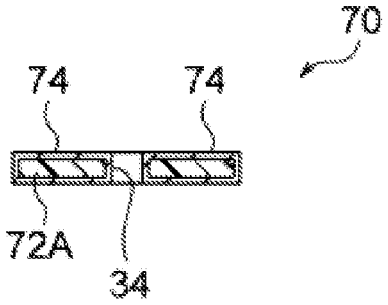
FIG. 19A is a sectional view taken along line 19A-19A of FIG. 18.
Figure 19B:
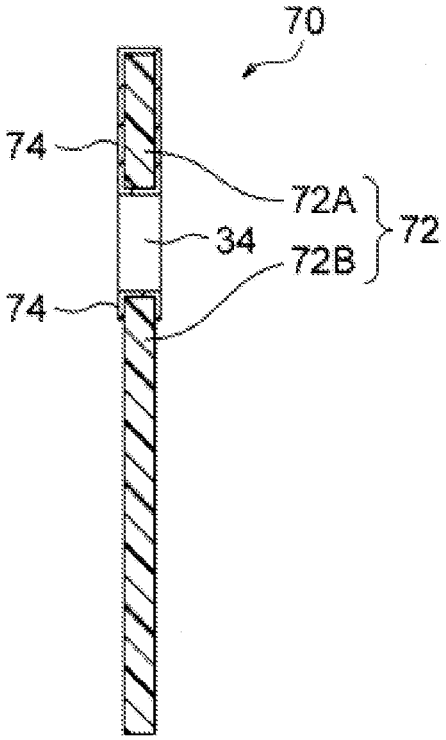
FIG. 19B is a sectional view taken along line 19B-19B of FIG. 18.

Furthermore, in the embodiment described above, the press-fit portion 32 is formed of, for example, a metal plate. However, for example, as in the press-fit pin 70 illustrated in FIGS. 18, 19A and 19B, the press-fit portion 32 may be formed by coating a surface of a non-conductive pin member 72 with a conductive film 74.

Specifically, the press-fit pin 70 has the non-conductive pin member 72. The non-conductive pin member 72 is formed of, for example, a non-conductive (insulative) resin. The tip end side of the non-conductive pin member 72 becomes a guide pin portion 72B.

Meanwhile, a base end side surface of the non-conductive pin member 72 is coated with a conductive film 74. Thus, a conductive press-fit portion 72A is formed at the base end side of the non-conductive pin member 72.

As such, the press-fit pin 70 may be formed by coating the base end side of the non-conductive pin member 72 with the conductive film 74. Further, the front end portion 72B1 of the guide pin portion 72B becomes a tapered portion.

Further, in the embodiment described above, the through hole 34 is formed in the press-fit portion 32 of the press-fit pin 30. However, a recess may be formed in the press-fit portion 32, instead of the through hole 34.

Furthermore, in the embodiment described above, the notch-shaped catch portion 36 is formed in the front end portion 32B of the press-fit portion 32. However, the shape of the catch portion may be changed. Moreover, the catch portion may be omitted.

Further, the connector 22 according to the embodiment described above is applicable to various substrates.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. A connector comprising:

a press-fit pin wherein the press-fit pin includes:

a press-fit portion having conductivity and configured to be press-fitted into a through hole formed in a substrate, and a guide pin portion having non-conductivity and extending from a front end portion of the press-fit portion, the guide pin portion being configured to be inserted into the through hole.

2. The connector according to claim 1, wherein a front end portion of the guide pin portion is located within the through hole in a state where the press-fit portion is press-fitted into the through hole.

3. The connector according to claim 1, wherein a front end portion of the guide pin portion is inserted into one opening of the through hole, and is located at a side of another opening of the through hole in a state where the press-fit portion is press-fitted into the through hole.

4. The connector according to claim 1, wherein a front end portion of the guide pin portion protrudes from the through hole in a state where the press-fit portion is press-fitted into the through hole.

5. The connector according to claim 1, further comprising:

a base portion engaged with the substrate, wherein the press-fit portion protrudes from the base portion, and is inserted into the through hole in a state where the base portion is engaged with the substrate.

6. The connector according to claim 1, wherein the guide pin portion is a resin member welded to the front end portion of the press-fit portion.

7. The connector according to claim 6, wherein a catch portion is provided on the front end portion of the press-fit portion, the guide pin portion being caught on the catch portion.

8. The connector according to claim 1, further comprising:

a non-conductive pin member inserted into the through hole, a tip end of the non-conductive pin member forming the guide pin portion, wherein the press-fit portion is formed by coating a surface of the non-conductive pin member with a conductive film.

9. The connector according to claim 8, wherein the non-conductive pin member is formed of a resin.

10. The connector according to claim 1, wherein a front end portion of the guide pin portion is a tapered portion that is narrowed toward a tip end.

11. The connector according to claim 1, wherein a through hole or a recess is formed in the press-fit portion to elastically deform the press-fit portion as the press-fit portion is press-fitted into the through hole.

12. The connector according to claim 1, wherein the press-fit portion is pressure-welded to an inner circumferential surface of the through hole.

13. An electronic device comprising:

a substrate having a through hole formed therein; and a connector having a press-fit pin inserted into the through hole, wherein the press-fit pin includes:

a press-fit portion having conductivity and configured to be press-fitted into the through hole; and a guide pin portion having non-conductivity and extending from a front end portion of the press-fit portion, the guide pin portion being configured to be inserted into the through hole.

14. The electronic device according to claim 13, wherein a front end portion of the guide pin portion is located within the through hole in a state where the press-fit portion is press-fitted into the through hole.

15. The electronic device according to claim 13, wherein a front end portion of the guide pin portion is inserted into one opening of the through hole, and is located at a side of another opening of the through hole in a state where the press-fit portion is press-fitted into the through hole.

16. The electronic device according to claim 13, wherein a front end portion of the guide pin portion protrudes from the through hole in a state where the press-fit portion is press-fitted into the through hole.

17. The electronic device according to claim 13, further comprising:

a base portion engaged with the substrate, wherein the press-fit portion protrudes from the base portion, and is inserted into the through hole in a state where the base portion is engaged with the substrate.

18. The electronic device according to claim 13, wherein the guide pin portion is a resin member welded to the front end portion of the press-fit portion.

19. The electronic device according to claim 13, wherein a front end portion of the guide pin portion is a tapered portion that is narrowed toward a tip end.

20. The electronic device according to claim 13, wherein a through hole or a recess is formed in the press-fit portion to elastically deform the press-fit portion as the press-fit portion is press-fitted into the through hole.

* * * * *